US005619843A

United States Patent [19]

Ganz

[11] Patent Number: 5,619,843

[45] Date of Patent: Apr. 15, 1997

[54] FILM WRAP MACHINE

[76] Inventor: Robert H. Ganz, No. 8 Ridgecrest Rd., Saddle River, N.J. 07458

[21] Appl. No.: 488,965

[22] Filed: Jun. 8, 1995

[51] Int. Cl.[6] ..... B65B 35/30; B65B 53/02; B65B 27/04

[52] U.S. Cl. ..... 53/543; 53/557; 53/588

[58] Field of Search ..... 53/48.2, 48.7, 53/210, 543, 557, 588

[56] References Cited

U.S. PATENT DOCUMENTS

| | | | |
|---|---|---|---|
| 3,791,100 | 2/1974 | Monaghan | 53/210 X |
| 3,866,386 | 2/1975 | Ganz | 53/557 X |
| 4,214,419 | 7/1980 | Allen et al. | 53/543 |
| 4,566,248 | 1/1986 | Cooley | 53/543 X |

*Primary Examiner*—Linda Johnson
*Attorney, Agent, or Firm*—William H. Holt; Charles E. Brown

[57] ABSTRACT

A machine for wrapping a plurality of articles into a package. The machine is provided with a film which comes in roll form and the film passes through a cutter but does not cut it entirely off. At the same time, generally parallel to the film there is a row of articles which are advanced and passed on to a guide which moves them onto the film. The film is then drawn after which the articles are advanced in unison and then the film is drawn about the articles. The group of articles are then passed on to rollers and into a shrink tunnel for shrinking of the film so as to tightly engage the articles. As the film is pulled into loops, the loops are supported by a vacuum conveyor so that the loops will stay ready for the eventual drawing of the film about the group of articles.

1 Claim, 3 Drawing Sheets

FILM WRAP MACHINE

INVENTION

This invent ion relates to a machine which is specially designed to take a roll of plastic, cut the plastic at intervals, wrap the plastic around a series of articles, and form packages of the articles wrapped with the material being broken.

This also relates to a machine wherein the articles to be wrapped are fed into the side of the machine at an angle to the plastic material and are then turned on top of the plastic material to run with the plastic materials so that a package may be formed.

PRIOR ART

Although this invention relates to a side entrance of articles being wrapped, it is well known in the prior art to enter the articles to be wrapped from the side. However, all prior patents relate to machines wherein the articles being wrapped are being placed within containers and are not being wrapped with a plastic material. This invention not only relates to the supplying of material within a roll, but also drawing that roll between adjacent packages so that horizontal drawing mechanisms may be utilized to pull the plastic material around the articles.

OBJECT OF THE INVENTION

This invention relates to a continuously operating machine wherein the articles, primarily cans, are wrapped within a plastic wrap to form packages. The plastic wrap is supplied in roll form and is cut at intervals with the cans entering the machine from a side and being turned at the last moment after the cans have been centered on top of the wrap. The wrap is then drawn around the cans to form a tight package after which the packages are placed in an oven wherein the plastic material is heat shrunk.

One of the features of the machine is that the plastic material, once it is drawn down between groups of cans, is supported by an endless vacuum conveyor which moves with the group of cans so as to support the plastic material.

Another feature of the invention is the number of platens may be interchanged so as to form packages of two or three rows and may form packages of different widths and therefore different numbers of containers depending upon the widths of the rolls.

A further feature of the invention is that underlying each of the supports for the containers are plastic material supports which serve among other things to support the plastic material as it is being drawn.

With the above and other objects in view that will hereinafter appear, the nature of the invention will be more clearly understood by reference to the following detailed description, the appended claims, and the several views illustrated in the accompanying drawings.

IN THE DRAWINGS

DESCRIPTION OF THE MACHINE

The machine is generally identified by the numeral 10 and is provided with a roll 12 of plastic film material which is acted on by natural forces so as to deteriorate and disappear.

Figure 1:
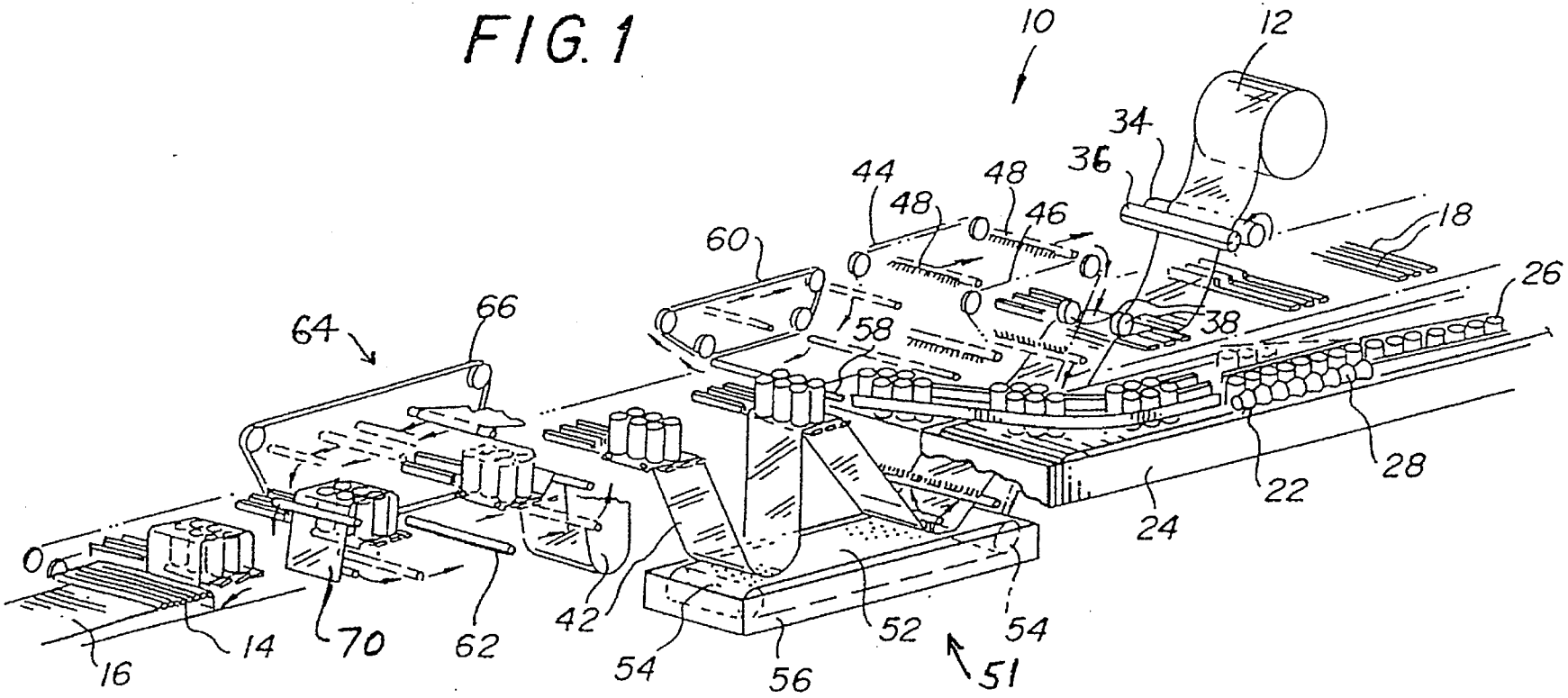
FIG. 1 is a perspective view of the machine in segments with the machine being viewed from the top and shows the mounting of the various elements thereof.

As is best shown in FIG. 1, the material of the roll 12 extends through the machine and is wrapped around a group of articles.

At the exit end of the machine 10, there is a group of rollers 14 in front of an oven conveyor 16. The wrapped around articles are then placed in the oven and the oven serves as a shrink tunnel for the collapse of the film around the articles.

The machine 10 is made up of a plurality of platens 18 which extend transversely of the machine. The platens 18 are arranged in groups and move continuously through the machine as the film of the roll 12 is payed out.

Beneath the platens 18 are rods 20 which are arranged in groups and are part of a conveyor which continuously moves at the same rate with the platens 18.

The rods 20 extend transversely of the machine and serve as film supports when required to prevent the film from dropping down.

Figure 3:
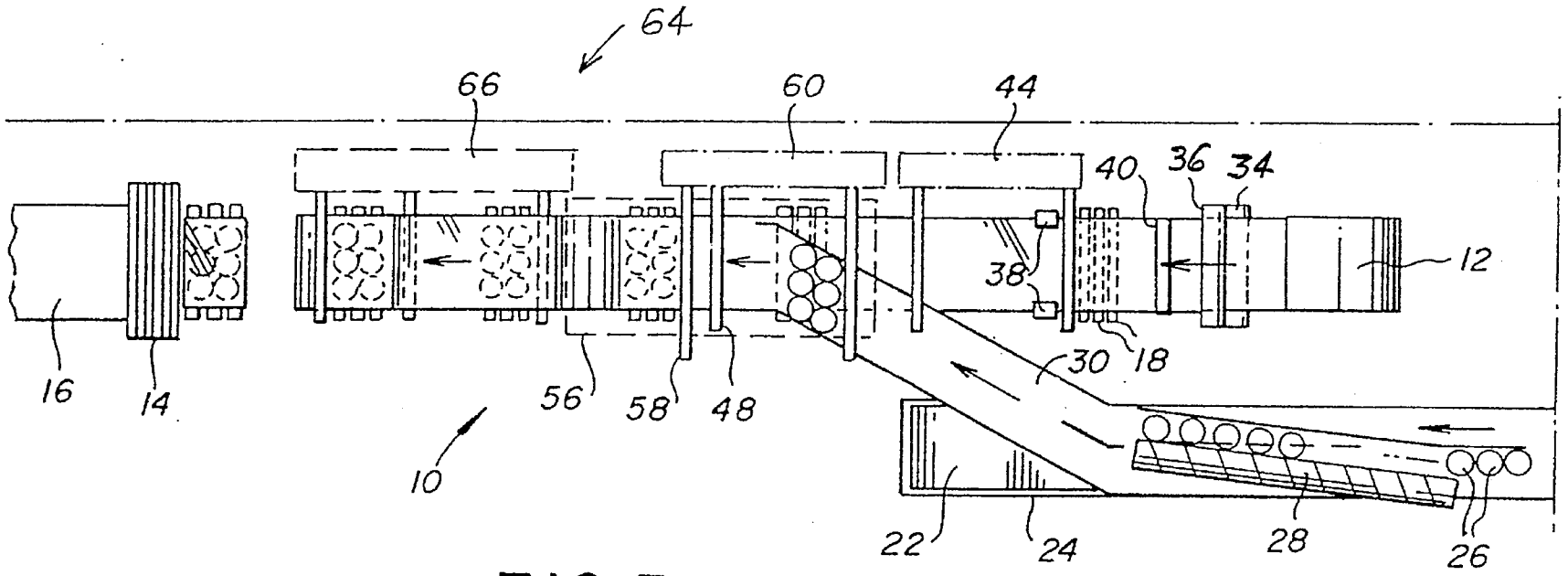
FIG. 3 is a top plan view of the machine and shows the manner in which cans are fed single file at intervals into the machine, then into groups of two or more rows at an angle and then are presented to the machine for wrapping by the film.

As is best illustrated in FIG. 1, there is a conveyor which is generally referred to by the numeral 22. The conveyor 22 is mounted within a housing 24 and runs alongside the platens 18. As is clearly shown in FIG. 3, the conveyor 22 runs alongside the path of travel of the film from roll 12. The conveyor 22 runs alongside the path of travel of the film. The conveyor 22 underlies a string of articles, such as cans 26, which are fed forward by means of the conveyor 22 in single file. There is adjacent the cans 26 a timing gear 28 which serves to place the cans in groups within a diagonal guide 30 to move the groups of cans onto the platins 18. The conveyor 22 underlies the guide 30 and, if desired, there may be a further conveyor (not shown). As the articles 26 move onto the platens 18, they are twisted so as to be aligned with the film of the roll 12.

Referring once again to FIG. 1, it will be seen that the film of the roll 12 passes first between a cutter 34 which is in roll form and a backup 36, which is also in roll form. Thus, the film of the roll 12 is cut partially through at intervals. The cut film continues along the path of the platens 18 and underlie the platens. These platens are caused to pass under a roll 38 after passing under a roll 40, which moves up and down between platens 18. The roll 38 causes the film of the roll 12 to overlie the platens 18.

The film of the roll 12 is pulled down in advance of a set of platens as at 42 to form a slight loop. As is best shown in FIG. 1, there are two conveyors 44 and 46 on opposite sides of the film of the roll 12. These two conveyors are driven in timed relation to the platens 18 and draw the film on the roll 12 further down in the loop 42 by means of transverse draw bars 48 to increase the length of the loop 42. The draw bars are provided with feathers 50 (FIG. 2) to brush the film of the roll 12 and move with the platens 18.

Below the film of the roll 12 there is a vacuum conveyor, generally indicated by the numeral 51, which includes a belt 52 through which a vacuum is pulled and over rollers 54 of which at least one is driven. The conveyor of the belt 52 supports the film of the roll 12 as it passes in loop 42. The belt 52 is mounted within a carrier 56.

Next there is a plurality of pusher bars 58 carried by a single conveyor 60. These engage the groups of articles seated on the film of the roll 12 and push the same along. This also may include pushing from the guide 30 onto the platens 18.

Next the film is engaged by a film bar 62 of a film wrapping bar section 64 which includes a conveyor 66.

Figure 2:
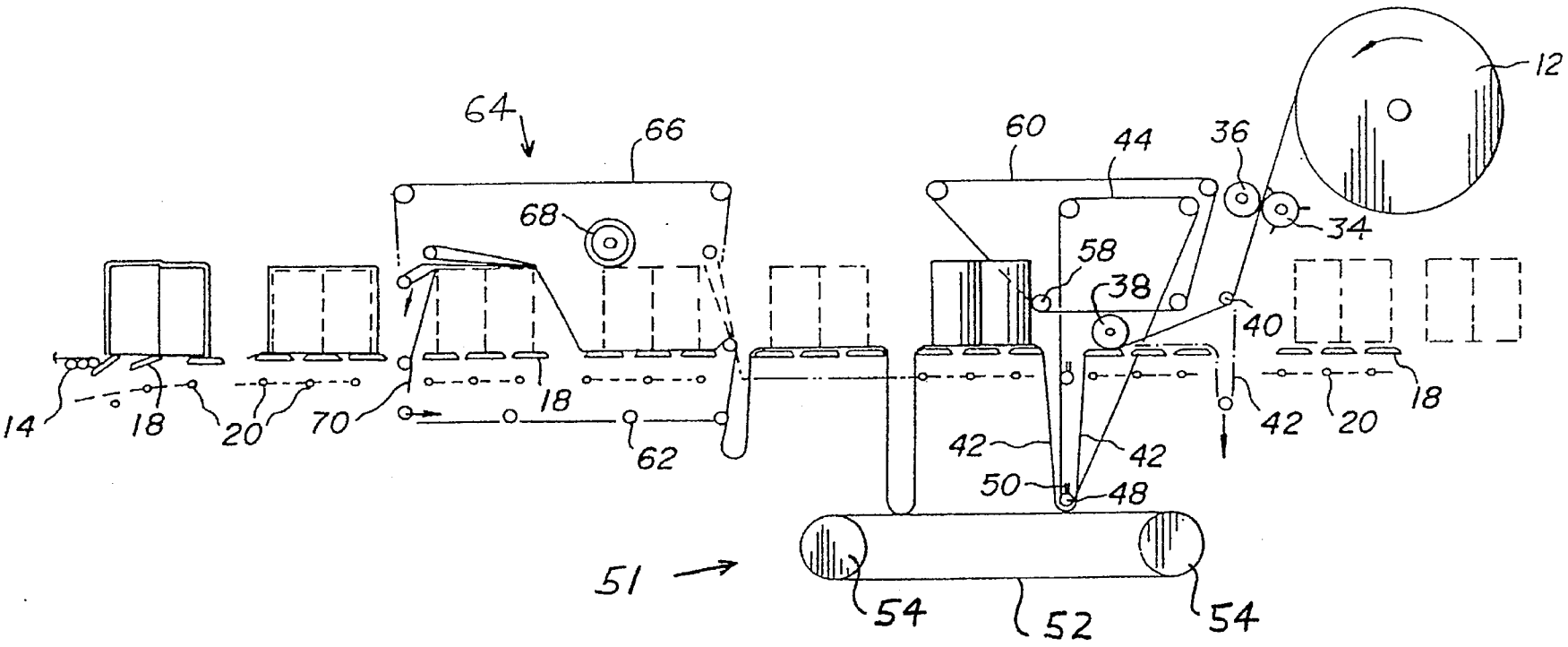
FIG. 2 is a side elevational view of the machine and shows the operation thereof with the machine showing a modified form of the invention wherein three rows of cans are being packaged.

The film bar 62 moves beneath the group of articles and the platens 18 and engages the front side of the pull down loop 42 as is shown in FIG. 2. The bar 62 then pulls the film up between two adjacent groups of articles and over top a group of articles where it engages a hold-down roller 68 at the moment the film engages the rearmost part of the underlying platens 18. This causes the film to break off along the previously cut line. The bar 62 continues further forward and down between adjacent groups of articles as is shown so as to provide a front flap of the film which terminates in an extension 70.

Eventually the group of articles pass over rollers 14 as the group of articles move onto the conveyor 16. This results in the rollers 14 moving the extension 70 beneath the bottom layer of the film and completes the wrapping of the film of the roll 12 about the group of articles.

As the conveyor 16 passes through the shrink tunnel, the film of the roll 12 shrinks and tightly engages the articles so as to form a package.

While the articles 26 have been illustrated as being cans or other cylindrical devices, it may be that the articles 26 be boxes, etc. As far as this invention is concerned, the machine 10 will wrap a plurality of different articles.

It is to be understood that the machine will be modifiable to receive packages of different sizes with the result that greater or lesser loops of film will be pulled and that the conveyor 51 will be vertically adjusted accordingly so as to support the loops.

I claim:

1. A wrapping machine for simultaneously wrapping a plurality of articles, said wrapping machine comprising means for moving plastic film material along a longitudinal extent of said machine; a group of platens extending transversely of said longitudinal extent of said machine and including means for moving said platens through said machine; a first conveyor (22) disposed adjacent said platens for feeding in a single file articles which are to be wrapped; a timing gear (28) cooperating with said conveyor for grouping the articles into article groups; diagonal guide means (30) for moving the article groups diagonally onto said platens and onto the film; feed means for introducing a length of film material into said machine, said feed means including a cutter roll (34) and a backup roll (36) for passing the film beneath said platens, said cutter roll providing means for partially cutting through the film at intervals thereof; means (38, 40) for causing the film to pass from beneath said platens to a position above said platens; conveyor means (44 and 46) including draw bars (48) for forming the film into loops; pusher bars (58) for engaging the article groups and moving them from said diagonal guide into alignment with said platens; film bar means (62) for pulling the film between article groups and for draping the film over one article group; means for breaking the film into intervals along the line created by said cutter roll (34); an oven conveyor comprising a shrink tunnel for collapsing and shrinking the film about the article groups; and means for moving the article groups from the wrapping machine into said oven conveyor.

* * * * *